US011752656B2

(12) United States Patent
Beerens

(10) Patent No.: US 11,752,656 B2
(45) Date of Patent: Sep. 12, 2023

(54) CUTTING LINK, A SAW CHAIN AND A CHAINSAW APPARATUS HAVING THE SAME, AND A METHOD FOR MANUFACTURING THE SAME

(71) Applicant: GB Product Development Ltd., Fife (GB)

(72) Inventor: Thomas Beerens, Fife (GB)

(73) Assignee: GB PRODUCT DEVELOPMENT LTD., Fife (GB)

( * ) Notice: Subject to any disclaimer, the term of this patent is extended or adjusted under 35 U.S.C. 154(b) by 91 days.

(21) Appl. No.: 16/923,166

(22) Filed: Jul. 8, 2020

(65) Prior Publication Data

US 2022/0009121 A1 Jan. 13, 2022

(51) Int. Cl.
*B27B 33/14* (2006.01)

(52) U.S. Cl.
CPC ..... *B27B 33/145* (2013.01)

(58) Field of Classification Search
CPC ... Y10T 83/909; Y10T 83/913; Y10T 83/917; Y10T 83/921; Y10T 83/925; B27B 33/145; B27B 33/14; B27B 33/141; B27B 33/142; B27B 33/144
See application file for complete search history.

(56) References Cited

U.S. PATENT DOCUMENTS 1,354,439 A * 9/1920 Mccormick ..... B23D 61/121 83/661
3,308,859 A 3/1967 Ehlen
3,469,610 A 9/1969 Silvon
6,112,632 A * 9/2000 Buchholtz ..... B27B 33/141 83/834
2006/0243097 A1* 11/2006 Raczykowski ..... B28D 1/124 76/112
2009/0107317 A1* 4/2009 Kewes ..... B27B 33/142 83/831
2014/0260875 A1* 9/2014 Harfst ..... B27B 33/14 76/112

FOREIGN PATENT DOCUMENTS

EP 0306767 A1 3/1989
JP H091540 A 1/1997

* cited by examiner

*Primary Examiner* — Phong H Nguyen

(74) *Attorney, Agent, or Firm* — Shumaker, Loop & Kendrick, LLP; James D. Miller

(57) ABSTRACT

A cutting link, a saw chain and a chainsaw apparatus having the same, and a method for manufacturing the same. The cutting link includes: a body; a depth gauge protruding upwardly from a top side of the body; and a cutting portion protruding upwardly from the top side of the body and located at rearward side of the depth gauge, wherein the cutting portion includes a cutting edge, a rake face adjacent to the cutting edge, and a clearance face adjacent to the cutting edge, and wherein the cutting portion has one or more hardened areas including a first surface hardened area which covers at least the rake face, with other areas of the cutting link being non-surface hardened areas. The chain is a single use chain with predictable long life and economical use, and capable of minimizing the risk of chain shot.

11 Claims, 5 Drawing Sheets

CUTTING LINK, A SAW CHAIN AND A CHAINSAW APPARATUS HAVING THE SAME, AND A METHOD FOR MANUFACTURING THE SAME

FIELD

The disclosure relates in general to a chainsaw for timber harvesting and a saw chain for the chainsaw, and particularly to a cutting link for the saw chain and a method for manufacturing the same.

BACKGROUND

Historically saw chains were designed for handheld 2 stroke petrol driven chain saws. This meant that as the chain became dull the lack of performance of the chain due to it becoming dull was immediately noticeable. The operator could "feel" the chain becoming dull. Saw chains would have to be frequently sharpened to allow the chain to cut.

It is well known that saw chain rapidly becomes dull. This greatly affects the performance of the saw chain and causes an increase in the stresses both between the components of the saw chain, between the saw chain and the guide bar and between the saw chain and the drive sprocket.

Conventional saw chain is designed to be sharpened many times during its service life. Each time the cutters (cutting portions) are sharpened a new cutting edge is produced. The cutters are designed to have a short rake face and a long clearance face. On this clearance face a deposit of hard chrome is deposited electrolytically. The original and subsequent cutting edges are formed by grinding or filing back the rake face, so a new section of the clearance face, hence the hard chrome, is exposed as the cutting edge. Once the hard chrome is worn away or dislodged from this edge it has become dulled. Also, once the hard chrome is removed from the edge the further dulling happens more rapidly as the underlying material is much softer than the hard chrome.

Modern timber harvesting is carried out using a hydraulic motor to drive the drive sprocket and a hydraulic cylinder to feed the saw chain and guide bar though the cut. Timber harvesters typically have 40 kW of power compared to the largest handheld saws having approximately 6 kW.

On timber harvesters the use of hydraulics and the availability of high power allows even the dullest chain to cut, putting extremely high stresses on the saw chain, guide bar and drive sprocket. When operating such a timber harvesting machine the operator cannot "feel" the chain becoming blunt.

Over time all the components of the chain become worn. The wear rate of these components is dependent on all cutting conditions and operating parameters, especially on the condition of the cutting link including the sharpness of cutting edge, the geometry of the cutter, and the height of the depth gauge. As the cutting speeds, the cutting loads and chain tensions on a harvester are much higher, the wear rate on the chain components is much greater. Much of the wear takes place in parts of the chain that cannot be seen.

In addition, further problems with the prior art are as follows.

Increase in Cost of Chain Maintenance

As the chain cost has come down significantly, the cost of sharpening a chain is approximately one third the price of a new chain, and meanwhile, the cost of chain maintenance is increased. Many harvester companies now do not sharpen the chain at all, but simply use it once and throw it out.

Cost of Loss of Productivity

Timber harvester machines are very productive. The value of the timber harvested could be as high as $800 per hour. Repeatedly sharpening the chain will bring cost of loss of productivity, and so the cost of changing the chain can be much higher than the cost of the chain itself.

Requirement of Necessary Art and Skill for Chain Sharpening

It is common for the chain to be sharpened repeatedly during its working life. Although a new cutting edge can be formed on the chain cutters it is impossible to rectify all the damage, eg. cracking, of other components of the saw chain. It is also common that the sharpening that is done, is done poorly, resulting in poor cutting performance and further damage to the components of the saw chain.

Sharpening cutting links requires a certain level of expertise to reach expected safety specifications as the cutting edge needs to reach a certain sharpness and geometry, and the depth gauge on the cutting links must be modified to the correct height for the saw chain to perform well. Often depth gauges are ignored as it is difficult to adjust correctly.

The cost of sharpening the cutting links is therefore increased because of the need for an expert to sharpen the cutting links. It is normal, however, for saw chain to be sharpened by people not trained or skilled in the art.

Danger Due to Chain Shot

Worn chain components lead to the chain breaking when in use. A broken saw chain is flung at high speed around the guide bar. This flinging may cause a small piece of chain to be broken loose from the saw chain. This piece of chain can fly off at speeds of over 300 m/s causing death or serious injury to operators or bystanders. This is known as in the timber harvesting industry as chain shot.

Due to the fast rate of becoming dull of existing cutting links, the required returns are obtained by operating the saw chain well after it has become dull.

The ability to operate the saw chain after it has become dull and the high cost of sharpening properly leads to a higher risk for operators and bystanders, due to damage done to the chain components by cutting with dull or poorly sharpened saw chain.

Difficulty of Determining and Monitoring the Life of a Saw Chain

As the sharpening of the chain is generally haphazard, inconsistent and difficult to examine for quality, it is therefore also near impossible to determine the expected edge life of a newly sharpened saw chain and therefore instruct an operator as to how much cutting should be done before further sharpening or disposal. Often a saw chain breaks immediately after sharpening.

Although modern harvesting machines keep an accurate record of the amount and type of timber cut, it is extremely difficult to monitor the life of an individual loop of saw chain. The saw chain may be removed from the harvester machine and taken to a workshop on many occasions during its service life for sharpening and repairing. It is currently recommended that a chain be discarded if it has been broken twice. As there is no serial number on the chain it cannot be traced, and knowledge is lost if the chain had been broken previously. In the forest, in transit and in the workshop, the chains are easily confused with others, making maintenance records for individual loops of saw chain near impossible to keep.

An early U.S. patent U.S. Pat. No. 3,308,859 discloses a self-sharpening saw chain in which the cuter is hardened by means of a carbonizing process. The cutter has a hard top surface and a hard side surface. From these surfaces there is a gradual transition of hardness to the interior or core of the cutter.

Since the core (including the rake face) of the cutter is softer than the hard top and side surfaces, the core will be abraded away much faster than the leading edge of the hard case of the top and side surfaces, so that the leading edge of the top and side surfaces will remain and function as a relatively sharp cutting edge which projects forwardly of the core.

The principle or method by which the cutter is self-sharpened is the wearing away of the softer material of the core as the cutter is used in service, while the sharp cutting edge is maintained at the top and side surfaces by the thin hard case.

In this case the cutting links were copper plated, and the copper was removed from the clearance face.

This was done to produce a "self-sharpening" chain. It is similar to the modern practice of hard chroming the clearance face.

In this solution, since the entire cutting edge is formed and supported by the hard top and side surfaces of the cutter, the softer core of the cutter cannot support the cutting edge during cutting, so the hardened surface layer is likely to peel off, causing management of the cutting edge and failure of the cutter.

SUMMARY

Some embodiments of The disclosure is to provide a cutting link, a saw chain and a chainsaw apparatus having the same, and a method for manufacturing the same to solve at least one technical problem existing in the prior art.

It is common to call a handheld chainsaw a "chainsaw" and a hydraulically driven chainsaw on a machine as "harvester". In this application, the term "chainsaw apparatus" is used to cover all harvesting machines that use saw chain and chainsaw bars, including the handheld chainsaw and the hydraulically driven mechanical chainsaw (the harvester).

According to one aspect of the disclosure there is provided a cutting link for a saw chain of a chainsaw apparatus, including: a body; a depth gauge protruding upwardly from a top side of the body; and a cutting portion protruding upwardly from the top side of the body and located at rearward side of the depth gauge, wherein the cutting portion includes a cutting edge, a rake face adjacent to the cutting edge, and a clearance face adjacent to the cutting edge, and wherein the cutting portion has one or more hardened areas including a first surface hardened area which covers at least the rake face, with other areas of the cutting link being non-surface hardened areas.

As a first surface hardened area covers at least the rake face, the rake face and the material immediately underneath form a hardened region. This hardened area has a hardness greater than the majority of the material of the cutting link, thus the wear of the rake face over time is reduced, and the life of the cutting link is increased. Further, as the rake face and the hard cutting edge are provided with support from the material immediately underneath them, therefore the cutting capability of the cutting link is improved.

In addition, the chain having such cutting links is a single use chain with long life, does not need to be re-sharpened in its life, and cannot be repaired if broken. This chain cannot be sharpened with a file, so cannot be sharpened in the forest. The edge life on this chain will be 3 or 4 times as long as a normal chain. So, the cutting link achieves economical use coming from one use. Long "up time" on the machine means no stopping during the life of the chain.

In addition, this chain has predictable edge life, allowing companies to monitor and control chain use. This will allow companies to manage the "usable" life of the chain to minimize or remove the risk of chain shot.

In an exemplary embodiment, the non-surface hardened areas cover at least the clearance face. The softer clearance face has better mechanical toughness and plasticity, which can provide good impact resistance for the cutting edge.

In an exemplary embodiment, a gullet is formed between the cutting portion and the depth gauge, and the first surface hardened area further covers a portion of the gullet adjacent to the rake face. By changing the shape of the gullet and increasing the wear resistance at this place, it facilitates the dispense of the wood piece in the gullet, and reduces the accumulation of the wood pieces on the rake face.

In an exemplary embodiment, the cutting portion includes: a cutting side plate portion, extending upward from the body and protruding from a first side of the body; a cutting top plate portion, extending laterally from the top end of the cutting side plate towards a second side of the body and protruding from the second side of the body; and a cutting corner portion, connecting the cutting side plate portion and the cutting top plate portion, the rake face includes: a first sharpening surface, formed at least on the cutting top plate portion and the cutting corner portion; and a second sharpening surface, formed on the cutting side plate portion, having a sharpening axis different from that of the first sharpening surface.

By providing different sharpening surfaces on the rake face, it can provide more different suitable cutting rake angles according to different cutting conditions and requirements of the cutting top plate portion and cutting side plate portion, such that the cutting performance of cutting link is improved.

In an exemplary embodiment, the cutting portion includes: a depth gauge side plate portion, extending upward from the body and protruding from a first side of the body; and a depth gauge top plate portion, extending laterally from the top end of the cutting side plate towards a second side of the body and protruding from the second side of the body.

By this, the depth gauge is not only used to control the cutting depth, but also can provide direction guidance for the cutting portion in operation so as to improve the cutting quality. It is normal for the depth gauge to not have this laterally extending top plate portion. Both the laterally extended depth gauge and the normal vertically extended depth gauge are all included within the protection scope of the present application.

In an exemplary embodiment, a bottom rail is formed at the bottom of the body, the bottom rail including a bottom rail toe and a bottom rail heel; and the one or more surface hardened areas further include a second surface hardened area provided at the bottom rail toe and/or the bottom rail heel. Therefore, the resistance of the bottom rail to wear, or wear life, is improved.

In an exemplary embodiment, the surface hardened areas have a thermo-chemical diffusion layer, preferably, the diffusion layer is formed by thermo-chemical diffusion process of atoms of any element of carbon, nitrogen and boron or any combination thereof. Using thermo-chemical diffusion process to obtain the surface hardened areas, it is easy for implementing with low cost.

In an exemplary embodiment, the thermo-chemical diffusion layer has a depth of between 0.1 mm and 1 mm, preferably, between 0.3 mm and 0.5 mm. This depth provides a sufficient layer to withstand wear for typical uses of the cutting link while keeping the manufacturing cost of the cutting link low.

In an exemplary embodiment, the thermo-chemical diffusion layer has a hardness of 58-64 HRc, preferably, 60-62 HRc; and the non-hardened area has a hardness of 45-55 HRc, preferably, 48-52 HRc. This hardness provides a sufficient layer to withstand wear for typical uses of the cutting link while keeping the manufacturing cost of the cutting link low.

In an exemplary embodiment, the non-hardened areas are covered with a masking layer, preferably, the masking layer is a copper plating layer. By selectively removing the masking layer to obtain the surface hardened areas, it is easy for implementing with low cost.

This is not the same as the early U.S. patent U.S. Pat. No. 3,308,859. In present disclosure the copper is removed from the rake face such that the rake face is hardened. While in the US patent U.S. Pat. No. 3,308,859 it is the clearance face (top and side surfaces of the cutter) is hardened.

According to another aspect of the present disclosure, there is provided a saw chain for a chainsaw apparatus, including cutting links, drive links, and side plates connected through rivets, wherein the cutting links are any of that above mentioned.

According to a further aspect of the present disclosure, there is provided a chainsaw apparatus including a saw chain as above mentioned.

According to a still aspect of present disclosure, there is provided a method for manufacturing a cutting link for a saw chain of a chainsaw apparatus, including a step of: punching out a blank workpiece of the cutting link from a steel strip, preferably, a low to medium carbon steel strip; wherein and hardening one or more surfaces of the blank workpiece to form one or more surface hardened areas including a first surface hardened area which covers at least a rake face of the cutting link, with other areas of the cutting link being non-surface hardened areas.

In an exemplary embodiment, the non-surface hardened areas cover at least clearance face of the cutting link.

In an exemplary embodiment, hardening one or more surfaces of the blank workpiece further includes: masking the blank workpiece with masking material to form a masking layer, preferably, by copper plating; removing the masking layer from predetermined areas of the blank workpiece, including sharpening a cutting portion of the blank workpiece to form and expose a rake face and cutting edge of the cutting portion; and making the exposed surface of the blank workpiece to be subjected to thermo-chemical diffusion process by placing the blank workpiece in an element-rich environment to form a thermo-chemical diffusion layer, and hardening the blank workpiece by heat treatment including quench to form said one or more surface hardened areas, preferably, the element including any of carbon, nitrogen, and boron, or any combination thereof.

In an exemplary embodiment, removing the masking layer from predetermined areas of the blank workpiece further includes: removing the masking layer from either or both of a bottom rail heel or a bottom rail toe of the blank workpiece.

BRIEF DESCRIPTION OF THE DRAWINGS

An example embodiment of the present disclosure will now be illustrated with reference to the following Figures in which.

IN THE FIGURES

180-non-hardened area; 100-cutting link; 105-rectangular body; 110-depth gauge; 115-cutting portion; 120-leading side; 125-trailing side; 130-cutting edge; 135-rake face; 135*a*-first sharpening surface; 135*b*-second sharpening surface; 140-clearance face; 143-cutting side plate portion; 144-cutting corner portion; 145-cutting top plate portion; 150-gullet 155-rivet holes; 160-bottom rail toe; 165-bottom rail heel; 200-chain; 210-drive link; 215-rivet hole; 220-side plate; 225-rivet hole; formed at least on the cutting top plate portion 145 and the cutting corner portion 144

Detailed Description of the Embodiments

The technical solutions in the embodiments of the present disclosure will be clearly and completely described herein below with the drawings in the embodiments of the present disclosure. It is apparent that the described embodiments are only part of the embodiments of the present disclosure, not all of the embodiments. The following description of at least one exemplary embodiment is only illustrative actually, and is not used as any limitation for the present disclosure and the application or use thereof. On the basis of the embodiments of the present disclosure, all other embodiments obtained on the premise of no creative work of those of ordinary skill in the art fall within the scope of protection of the present disclosure.

Figure 1A:
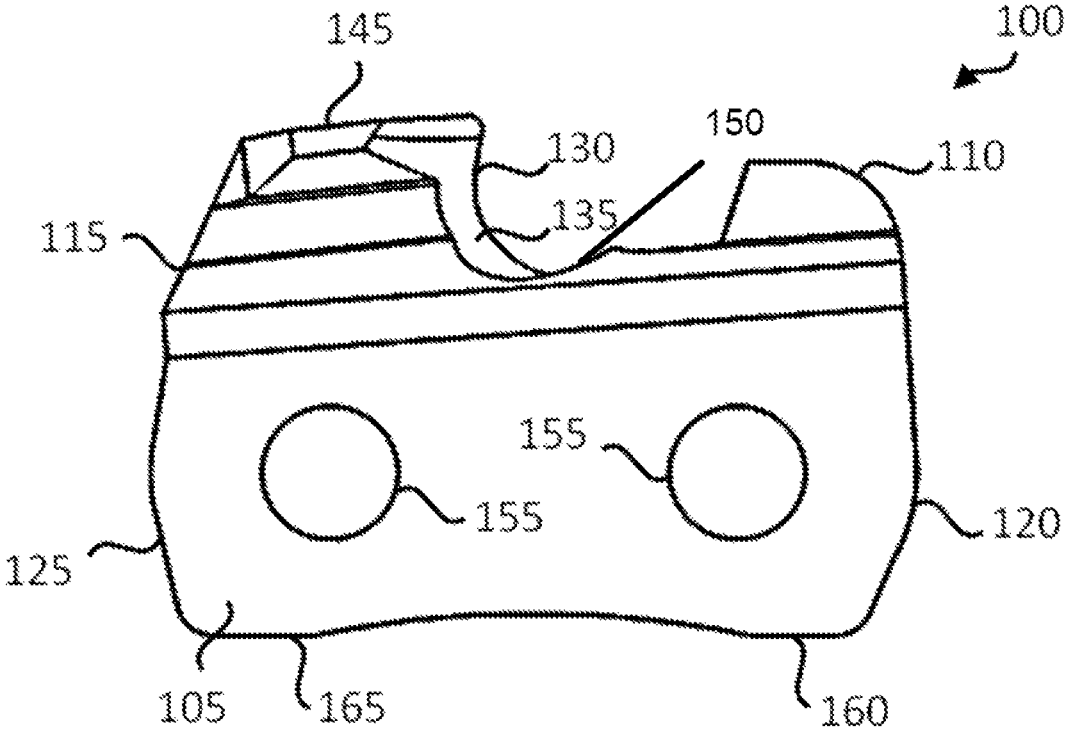
FIG. 1A is a side view of a cutting link according to an embodiment of the present disclosure.
Figure 1B:
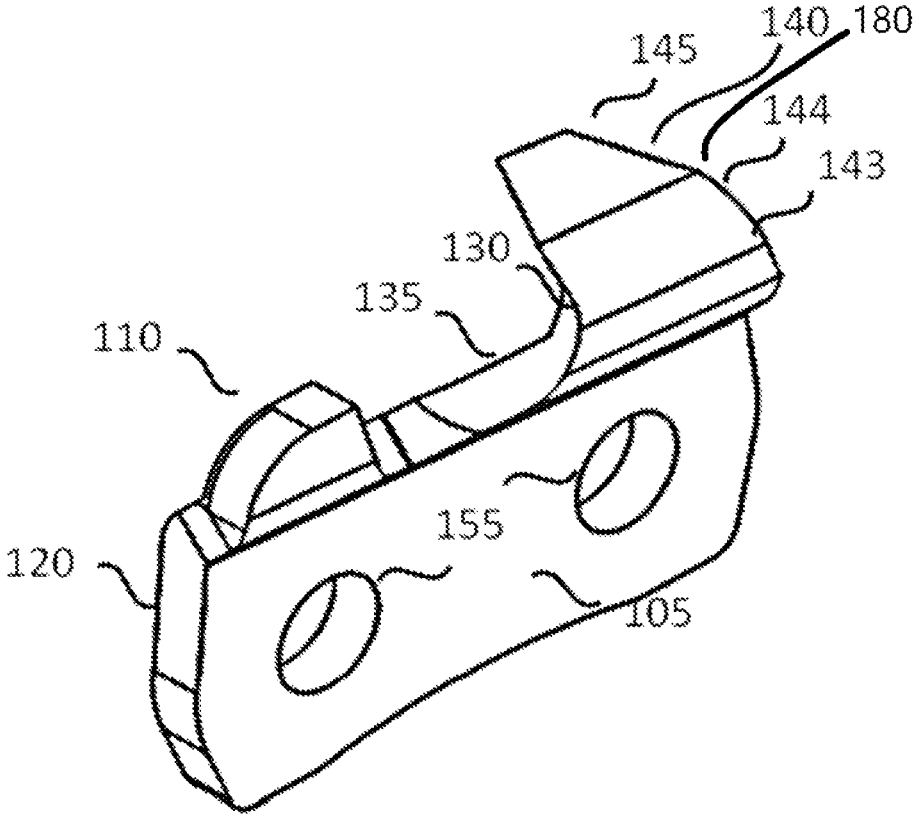
FIG. 1B is a perspective view of the cutting link of FIG. 1A.
Figure 1C:
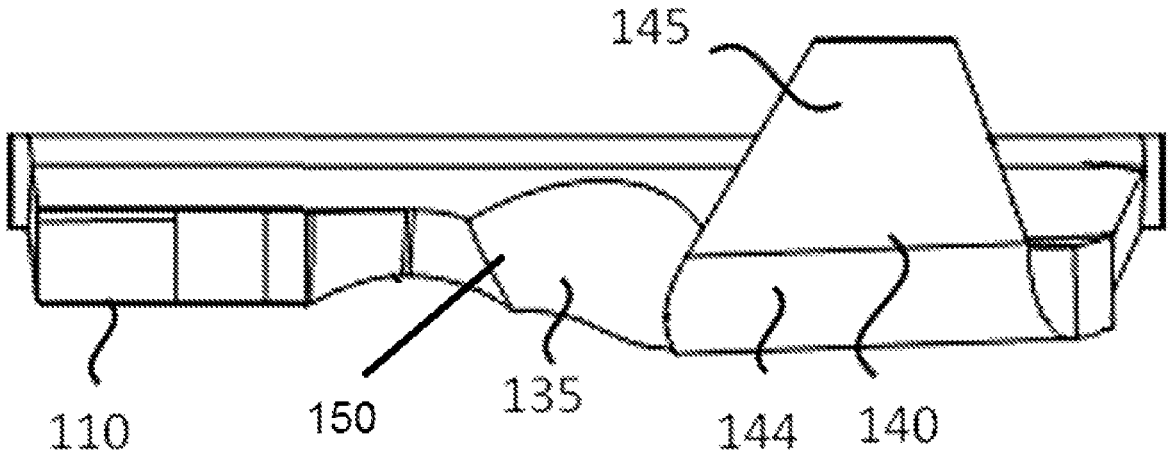
FIG. 1C is a top view of the cutting link of FIG. 1A.
Figure 1D:
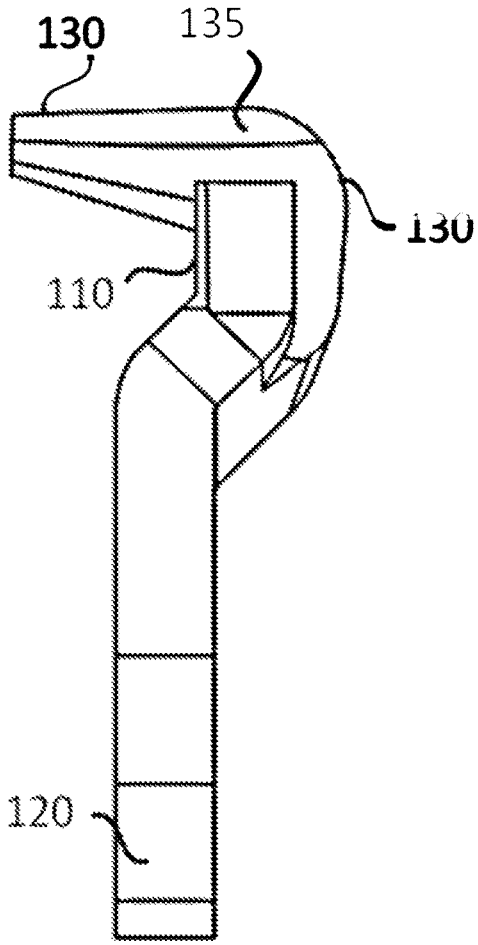
FIG. 1D is a front view of the cutting link of FIG. 1A.

FIG. 1A-1D display a cutting link of the present disclosure. The cutting link is displayed from a side view (FIG. 1A), a perspective view (FIG. 1B) which shows an opposite side of the cutting link 100 opposite to that of FIG. 1A, a top view (FIG. 1C), and a front view (FIG. 1D).

The cutting link 100 has a flat, rectangular body 105, a depth gauge 110 and a cutting portion (or a cutter) 115. The body 105 of the cutting link has a leading side 120 (i.e. a frontmost side) which is in the direction of travel when in use and trailing side 125 which is away from the direction of travel when in use. The depth gauge 110 protrudes outwardly from the body 105 of the cutting link 100 towards the leading side 120 of the cutting link 100. The cutting portion 115 protrudes outwardly from the body 105 of the cutting link 100 towards the trailing side 125 (i.e. a rearward side) of the cutting link 100. That is, at the end of the cutting link 100 away from the direction of travel. The side of the body 105 which the depth gauge 110 and the cutting portion 115 protrude from will hereinafter be referred to as the top side of the cutting link 100.

Figure 2A:
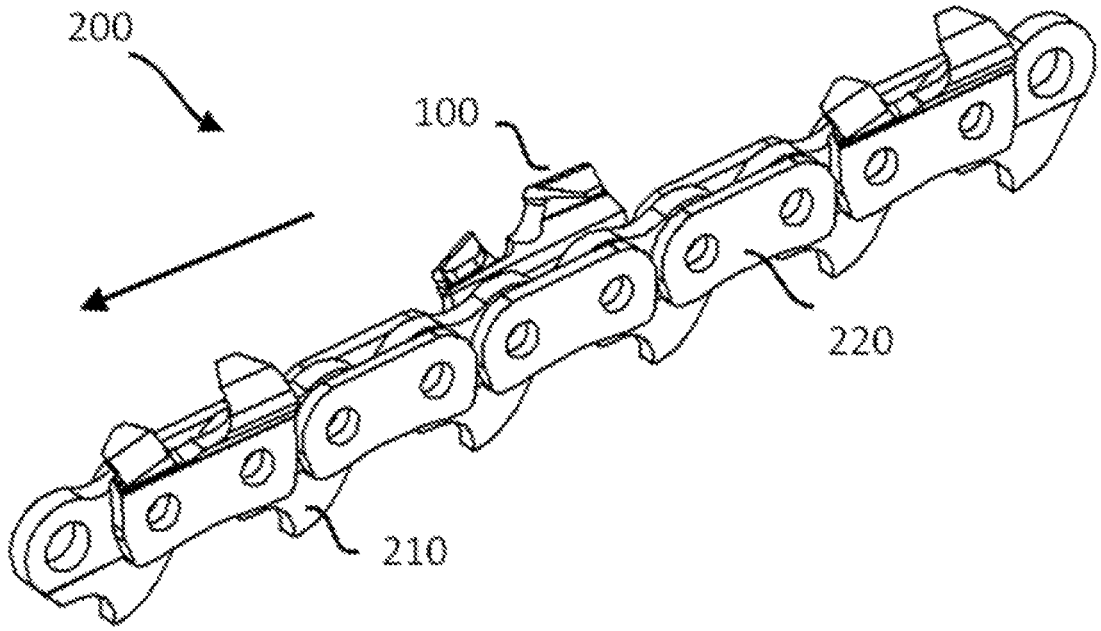
FIG. 2A is a perspective view of an example of a saw chain with the cutting link of FIGS. 1A-1D.

The depth gauge 110 determines how deep the cutting portion 115 will cut when in operation. Particularly, it is the difference in height between the depth gauge 110 and the cutting portion 115. A higher depth gauge (i.e. less difference) results in less material being cut, whereas a shorter depth gauge (i.e. more difference) results in more material being cut. The depth gauge can be made with many configurations by these skilled in the art. FIG. 1B shows one example of vertical depth and FIG. 2A shows a depth gauge that has been bent over.

The cutting portion 115 includes a cutting edge 130, a rake face 135 adjacent to the cutting edge, a clearance face 140 also adjacent to the cutting edge 130 (located on the opposite side of the cutting edge 130 relative to the rake face 135). The clearance face consists of 3 continuous surfaces, the top side surface of a cutting top plate portion 145, the outer surface of a cutting corner portion 144, and the outer surface of a cutting side plate portion 143. The cutting edge 130 and the rake face 135 are positioned to face towards the direction of travel, i.e. towards the leading face 120. The cutting portion 115 is normally constructed with a horizontal top plate portion, an almost vertical side plate portion and a corner radius portion. It can be made with a sharp corner, nearly a zero radius, or the 3 surfaces can be produced with one smooth arc. The cutting edge 130 extends along the curvature of the cutting portion 115, up the side plate portion, around the corner radius portion and along the top plate portion 145. The top plate portion 145 is typically flat and defines the top of the cutting edge 130 and the height of the cutting portion 115. The cutting edge 130 is configured to cut in multiple axes, horizontally and vertically, both axis perpendicular the axis of travel.

The cutting link is formed at first as a metal pressing. The rack face 135 is the new surface formed by machining or grinding of the cutting link at a compound angle.

The rake face 135 and the material immediately underneath it is a hardened area. This hardened area has a hardness greater than the majority of the material of the cutting link 100 thus reducing the wear of the rake face 135 over time. And the hard cutting edge 130 is provided with support from the material immediately underneath it, therefore improving the cutting capability of the cutting link 100.

Typically, the hardened area of the rake face 135 has been obtained by a thermo-chemical diffusion process. That is, the hardened area of the rake face 135 has been heated in an environment rich in an element, to allow the area to absorb atoms. The absorbed atoms create a diffused layer at the surface of the area, thus creating a surface which has a greater hardness and is therefore more resistant to wear. It may be that the thermo-chemical process includes an environment rich in carbon (carburization), nitrogen (nitridization) or boron (boronization) or any combination thereof. As a result, the hardened area of the rake face 135 has a structural composition that differs from the rest of the cutting link 100.

The diffused layer of the hardened area may extend to a particular depth from the surface. For example, it may be that the hardened area extends to a depth of between 0.1 mm and 1 mm. Preferably, the hardened area extends to a depth of 0.5 mm below the surface. This depth provides a sufficient layer to withstand wear for typical uses of the cutting link 100 while keeping the manufacturing cost of the cutting link 100 low.

The cutting link 100 includes rivet holes 155, typically two rivet holes. The rivet holes 155 are used to secure multiple components together when forming a chain (see, for example, FIG. 2A).

The bottom side of the cutting link 100 (i.e. the side opposite the top side of the cutting link 100) is referred to as the bottom rail. The bottom rail comes into contact with a guide bar and a drive sprocket when a saw chain including the cutting link 100 is assembled and in use. The portion of the bottom rail towards the leading side 120 of the cutting link 100 is the bottom rail toe 160, and the portion towards the trailing side 125 of the cutting link 100 is the bottom rail heel 165. It may be that these two surfaces, the bottom rail toe 160 and the bottom rail heel 165 are also hardened by a thermo-chemical diffusion process.

FIG. 1D displays the cutting link 100 from a front view. It can be clearly seen the portions of the cutting edge 130 and rake face 135 which are visible over the depth gauge 110. It is these portions which will cut into the material when in use. It can therefore be clearly seen that altering the height of the depth gauge 110 also alters how deep the cutting portion 115 will cut.

When in use, it can be seen that the clearance face 140 is not visible from this front view. Therefore, it is the rake face 135 which comes into contact with material being cut. The hardened area of the rake face 135 allows the cutting edge 130 to maintain its integrity for longer as it will be more resistant to wear, i.e. it will not wear down as quickly as if it were not hardened. This therefore maintains the sharpness of the cutting edge 130.

FIG. 2A displays a portion of an exemplary saw chain 200 including the cutting link 100 as described above when assembled. The portion of chain 200 includes three cutting links 100 which have been assembled in an alternative left-right configuration. That is, two cutting links 100 are on the left side (i.e. the foremost side) of the chain 200 and one cutting link 100 is located on the right side (i.e. the opposite side) of the chain 200. The cutting links 100 are assembled such that they are equidistant from each other. The configuration may be extended along the entire length of the chain, but alternative configurations are also envisaged, particularly where a larger gap is used between each pair of left and right cutting links.

Figure 2B:
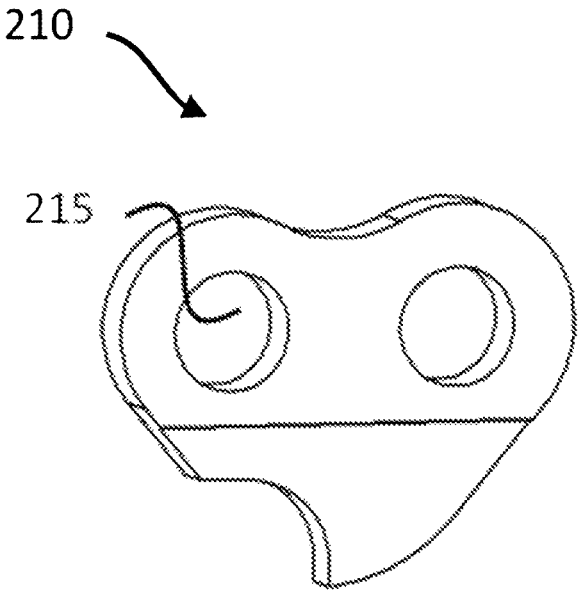
FIG. 2B is a schematic of a drive link.

Each cutting link 100 is attached to two drive links 210, each rivet hole 155 of the cutting link 100 is for one of the two drive links. FIG. 2B displays the drive link 210 in isolation. Each cutting link 100 and drive link 210 are attached by rivets (not shown) through the rivet holes 155 of the cutting link 100 and the rivet holes 215 of the drive link 210. The drive link 210 is used to engage with a drive sprocket (not shown) to propel the chain around a guide bar (not shown) when in operation. In the example of FIG. 2A, there are six drive links 210.

Figure 2C:
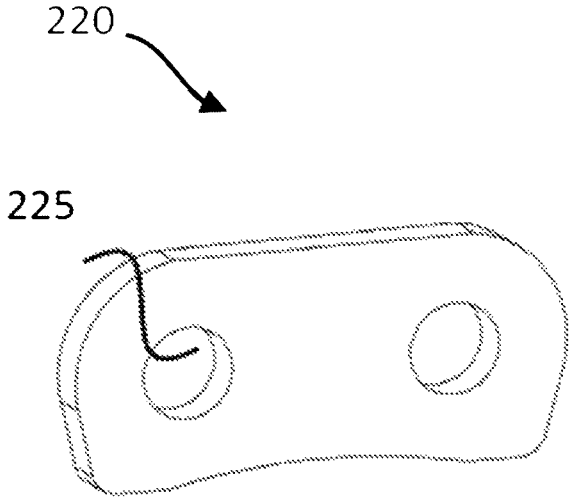
FIG. 2C is a schematic of a side connection plate.

The chain also includes a plurality of side plates (or joining links) 220. In FIG. 2A, three side plates 220 are shown on the left side (foremost side of the paper) of the chain 200 and four are shown on the right side of the chain 200. The side plates 220 paired with another side plate or a cutting link secure the chain together by attaching adjacent drive links 210. The side plates 220 are attached to the drive links 210 by rivets (not shown) through the rivet holes 225. There are three side plates 220 between each and subsequent cutting links 100 on the same side (as shown in FIG. 2A). FIG. 2C displays a side plate 220 in isolation.

When in operation, the cutting links 100 move such that the cutting edges 130 of the cutting links 100 face in the travel of direction. In the example of FIG. 2A, this would be from right to left. It can be seen that the rake face 135 will contact the material to be cut.

As an example, it may be that the cutting link 100 is being used to cut wood (either a standing tree or a portion which has already been felled). When used to cut, the cutting edge 130 and the rake face 135 come into contact with the wood. The depth at which the cutting link 100 will cuts the wood depends on the depth gauge 110 (i.e. the height difference between the top of the cutting portion 115 and the height of the depth gauge 110). While the cutting edge 130 is used to cut the wood, the rake face 135 is used to help remove cut pieces from the bulk of the wood.

Figure 3:
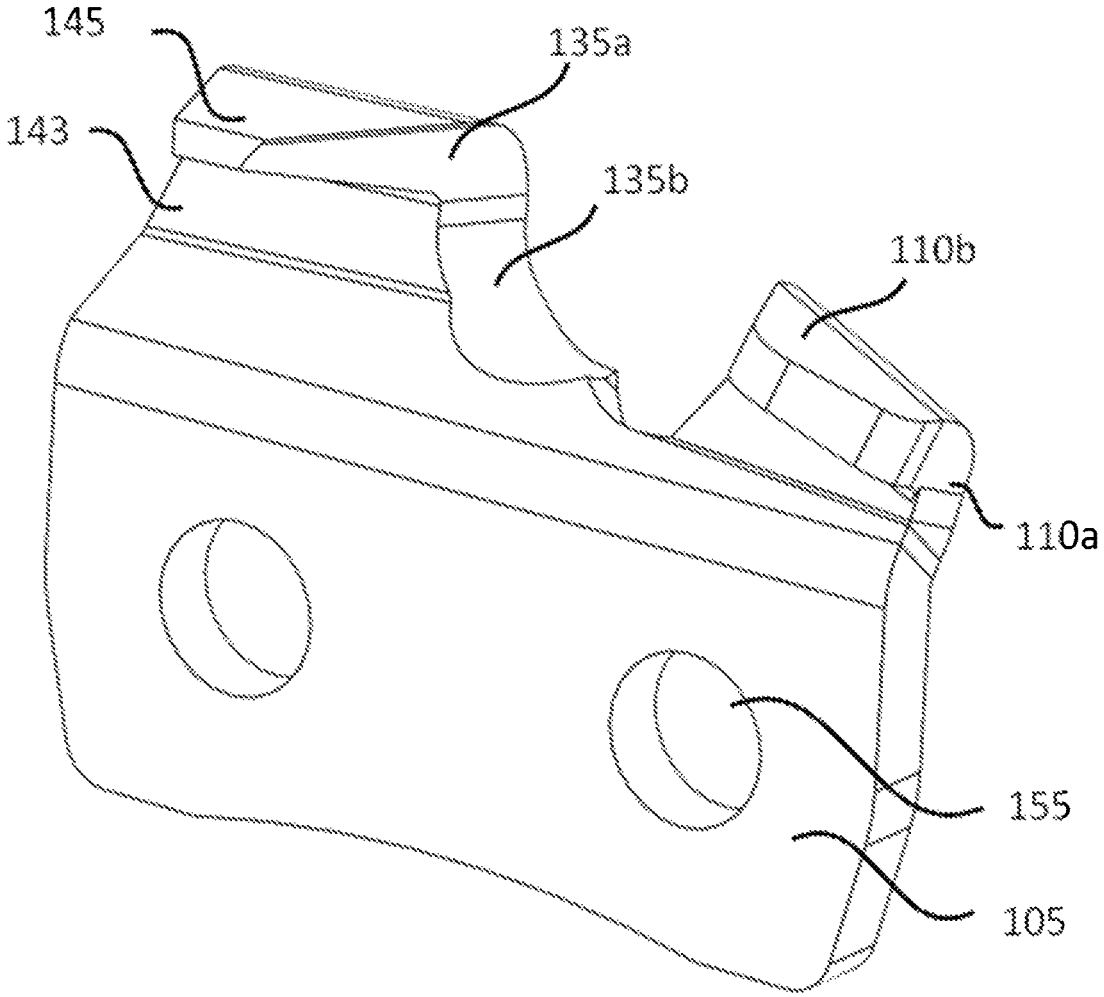
FIG. 3 is a perspective view of a cutting link according to another embodiment of the present disclosure.

FIG. 3 is a perspective view of a cutting link according to another embodiment of the present disclosure. From FIG. 3 it can be seen that the cutting portion 115 includes a depth gauge side plate portion 110*a*, extending upward from the body 105 and protruding from a first side of the body 105; and a depth gauge top plate portion 110*b*, extending laterally from the top end of the depth gauge side plate portion 110*a* towards a second side of the body 105 and protruding from the second side of the body 105. So the depth gauge has its top portion (the depth gauge top plate portion) wider, such that the depth gauge is not only used to control the cutting depth, but also can provide direction guidance for the cutting portion in operation so as to improve the cutting quality.

From FIG. 3 it can also be seen that the rake face 135 of the cutting portion 115 includes: a first sharpening surface 135*a*, formed at least on the cutting top plate portion 145 and the cutting corner portion 144; and a second sharpening surface 135*b*, formed on the cutting side plate portion 143, having a sharpening axis different from that of the first sharpening surface 135*a*. So it can provide more different suitable cutting rake angles according to different cutting conditions and requirements of the cutting top plate portion and cutting side plate portion such that the cutting efficiency is improved.

Figure 4:
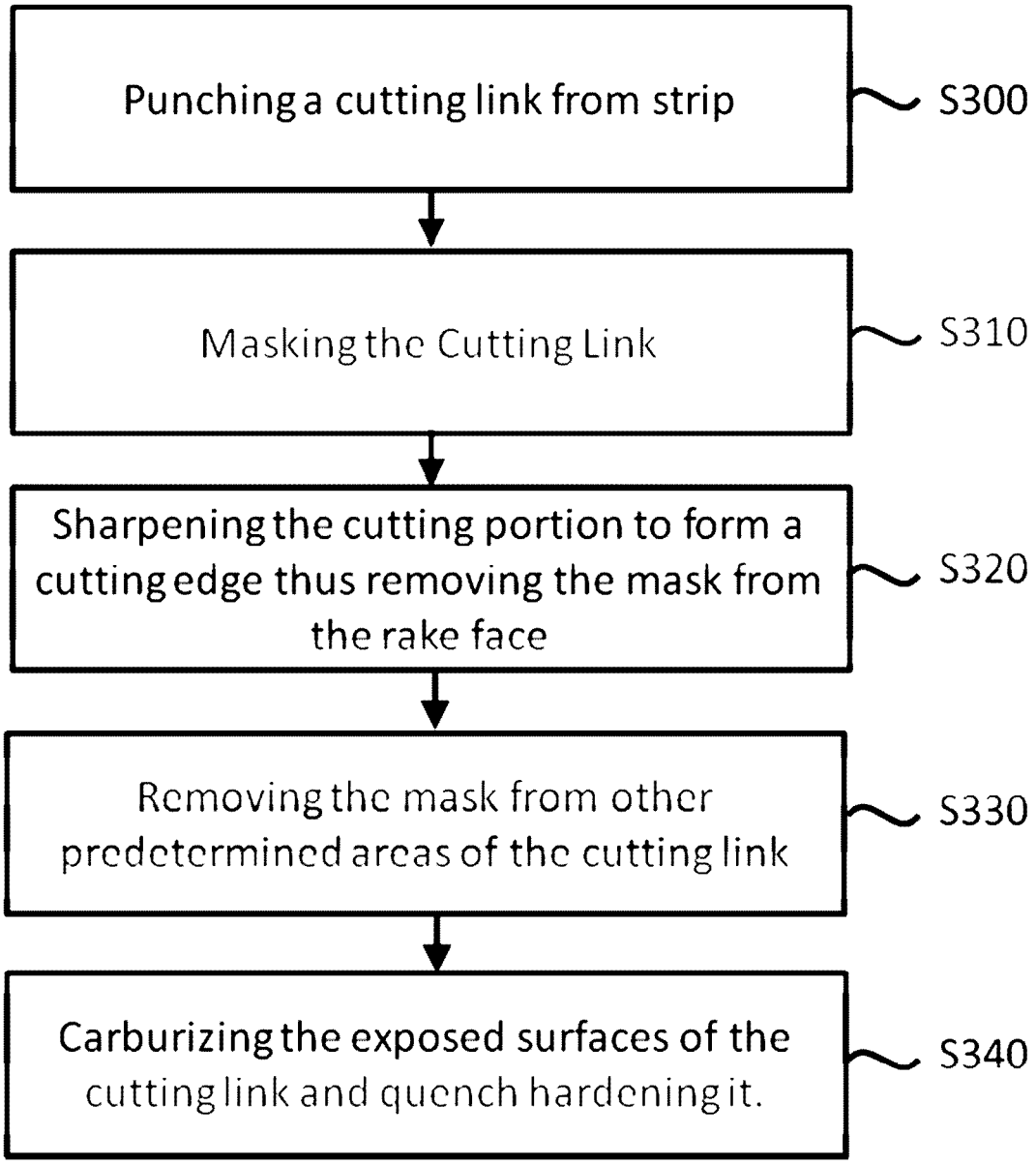
FIG. 4 is a flowchart of a method of manufacturing the cutting link according to the present disclosure.

FIG. 4 provides a method of manufacturing the cutting link as described above.

In step S300, a workpiece is punched from steel strip. This steel strip would normally be a low to medium carbon steel.

In step S310, the workpiece is masked with a material. The masking material may be, for example copper. The selection of masking material used may be dependent on the hardening process to be used in step S340. The masking material is chosen and deposited in sufficient thickness and quality to protect the surfaces that are masked from the thermo-chemical diffusion process.

In step 320, a cutting edge of the cutting portion is formed by sharpening the cutting portion. For example, it may be that the cutting edge is formed by grinding or machining the cutting portion. This sharpening creates the rake face and cutting edge of the cutter. By exposing the newly formed rake face, this surface is now vulnerable to the diffusion of new elements in the thermo-chemical diffusion process.

In step 330, it may be that other surfaces of the cutting link may be exposed. For example, the masking can be removed from either or both of the bottom rail heel or the bottom rail toe so that these surfaces are also vulnerable to the diffusion process.

In step S340, the exposed surface(s) (the rake face and optionally the bottom rail) is hardened. The hardening process may be a thermo-chemical process applied to the exposed surface(s). That is, it may be that the exposed surface(s) are hardened by subjecting the workpiece to an elevated temperature in an environment rich in an element, or a plurality of elements. The element-rich environment may be a carbon-, nitrogen- or boron-rich environment (i.e. a carburizing, nitridizing or boronizing process, respectively). The thermo-chemical process causes a diffused layer to exist at the surface of the exposed surface(s). That is, the surface of the exposed surface(s) becomes rich in the selected element(s) typically to a depth of between 0.1 mm and 1 mm, preferably 0.3 mm. The depth of the diffused layer may depend on several factors, for example the length of time of the hardening process, the temperature the workpiece is exposed to, or the richness of the environment. The last stage of this process is to rapidly lower the temperature, quench the cutting link. The process of quenching the material produces a material with different hardness's due to their different chemical compositions. The surfaces that have been modified by the thermo-chemical diffusion process would have a hardness of approximately 60HRc (58-64 HRc) whilst the other parts of the material would have substantially lower hardness's, typically 50 HRc or between 45 and 55 HRc.

In thermo-chemical treatments, the properties of the material is altered through the diffusion of Carbon, Nitrogen or Boron in rich environment through the surface of the steel, and the surface hardness in steels is increased by producing metal carbides, nitrides and borides. The areas where not carburized will be tougher.

There are a number of masking methods where materials can be used to coat the metal substrate to protect areas from carburizing. Copper is one of them. Carbon and nitrogen are insoluble in Copper.

Hardening one or more surfaces of the blank workpiece can be achieved by either selectively removing mask (masking layer) or selectively applying mask.

Selectively removing mask (masking layer) means after coating with a masking material, areas can be exposed by selectively removing the mask (masking material) to expose selected areas.

Selectively applying mask means during coating of the maskant, care can be taken to leave selected areas uncoated.

There are other methods to protect the surface using other stop-off materials. These are either painted on or dipped in. As we need to machine the part after coating then these processes do not offer the advantages of copper plating.

There are two popular methods of copper plating, Cyanide and Alkaline.

Some copper of the toe and heal of the cutting link can also be grinded, allowing these edges to also be carburized. This will increase their wear life. This is not necessary however.

Whilst I have described in the foregoing embodiment a specific concept, forms and application of my disclosure, it will be understood by some persons skilled in this particular art that variations, modifications, substitutions and additions may be made without departing from the spirit and scope of The disclosure and I therefore do not wish to be understood as limiting ourselves to the precise terms used.

What is claimed is:

1. A cutting link for a saw chain of a chainsaw apparatus, comprising:

a body;

a depth gauge protruding upwardly from a top side of the body; and a cutting portion protruding upwardly from the top side of the body and located at rearward side of the depth gauge, wherein the cutting portion comprises a cutting edge, a rake face adjacent to the cutting edge, and a clearance face adjacent to the cutting edge, and wherein the cutting portion has one or more surface hardened areas comprising a first surface hardened area which covers at least the rake face, a gullet is formed between the cutting portion and the depth gauge, and the first surface hardened area further covers a portion of the gullet adjacent to the rake face, a bottom rail is formed at a bottom of the body, the bottom rail comprising a bottom rail toe and a bottom rail heel; and the one or more surface hardened areas further comprise a second surface hardened area provided at the bottom rail toe and/or the bottom rail heel, other areas of the cutting link are non-surface hardened areas, the non-surface hardened areas cover at least the clearance face, the one or more surface hardened areas have a thermo-chemical diffusion layer, the thermo-chemical diffusion layer has any element of carbon, nitrogen and boron or combination thereof with the carbon, the thermo-chemical diffusion layer has a depth of between 0.1 mm and 1 mm, the clearance face consists of three continuous surfaces, a top side surface of a cutting top plate portion, an outer surface of a cutting corner portion, and an outer surface of a cutting side plate portion, the rake face comprises:

a first sharpening surface, formed at least on the cutting top plate portion and the cutting corner portion; and a second sharpening surface, formed on the cutting side plate portion, having a sharpening axis different from that of the first sharpening surface.

2. The cutting link as claimed in claim 1, wherein the cutting portion further comprises:

a cutting side plate portion, extending upward from the body and protruding from a first side of the body;

a cutting top plate portion, extending laterally from a top end of the cutting side plate portion towards a second side of the body and protruding from the second side of the body; and a cutting corner portion, connecting the cutting side plate portion and the cutting top plate portion, and wherein the rake face further comprises:

a first sharpening surface, formed at least on the cutting top plate portion and the cutting corner portion; and a second sharpening surface, formed on the cutting side plate portion, having a sharpening axis different from that of the first sharpening surface.

3. The cutting link as claimed in claim 1, wherein the cutting portion further comprises:

a depth gauge side plate portion, extending upward from the body and protruding from a first side of the body; and a depth gauge top plate portion, extending laterally from a top end of the depth gauge side plate portion towards a second side of the body and protruding from the second side of the body.

4. The cutting link as claimed in claim 1, wherein the thermo-chemical diffusion layer has a depth of between 0.3 mm and 0.5 mm.

5. The cutting link as claimed in claim 1, wherein the thermo-chemical diffusion layer has a hardness of 58-64 HRc; and the non-hardened area has a hardness of 45-55 HRc.

6. The cutting link as claimed in claim 5, wherein the thermo-chemical diffusion layer has a hardness of 60-62 HRc; and the non-hardened area has a hardness of 48-52 HRc.

7. The cutting link as claimed in claim 1, wherein the non-hardened areas are covered with a masking layer.

8. The cutting link as claimed in claim 1, wherein the masking layer is a copper plating layer.

9. A saw chain for a chainsaw apparatus, comprising cutting links, drive links, and a side plate connected through rivets, wherein the cutting links are that as claimed in claim 1.

10. The saw chain as claimed in claim 9, wherein the cutting portion further comprises:

a cutting side plate portion, extending upward from the body and protruding from a first side of the body;

a cutting top plate portion, extending laterally from a top end of the cutting side plate portion towards a second side of the body and protruding from the second side of the body; and a cutting corner portion, connecting the cutting side plate portion and the cutting top plate portion, and wherein the rake face further comprises:

a first sharpening surface, formed at least on the cutting top plate portion and the cutting corner portion; and a second sharpening surface, formed on the cutting side plate portion, having a sharpening axis different from that of the first sharpening surface.

11. A chainsaw apparatus comprising a saw chain as claimed in claim 9.

* * * * *